United States Patent [19]

Hawkes

[11] 4,151,936

[45] May 1, 1979

[54] WEARABLE CONTAINER

[76] Inventor: Geoffrey Hawkes, 34 Church La., Stanfree, Nr. Chesterfield, Derbyshire, England

[21] Appl. No.: 891,725

[22] Filed: Mar. 30, 1978

[51] Int. Cl.[2] ..... A45F 5/02

[52] U.S. Cl. ..... 224/224; 2/321; 2/338; 211/14; 224/919

[58] Field of Search ..... 224/26 R, 26 B, 26 C, 224/28 R, 28 B, 28 D, 26 D, 26 K, 26 F, 13, 14, 21, 22, 23, 24, 5 R, 5 A, 5 B, 5 C, 5 D, 5 L, 45 L; 2/311, 312, 318, 319, 320, 321, 338; 211/14

[56] References Cited

U.S. PATENT DOCUMENTS

| | | | |
|---|---|---|---|
| 1,321,843 | 11/1919 | Parkhill | 2/338 X |
| 1,911,256 | 5/1933 | Andrew | 224/5 D UX |
| 3,004,519 | 10/1961 | Weissman | 2/321 X |
| 4,079,871 | 3/1978 | Sica | 224/5 D |

*Primary Examiner*—Trygve M. Blix
*Assistant Examiner*—Jerold M. Forsberg

[57] ABSTRACT

An elongated container for captively retaining a plurality of articles which provides for easy insertion and removal of individual articles from the container throughout a length thereof and which container may be worn by an individual.

6 Claims, 3 Drawing Figures

WEARABLE CONTAINER

Although containers constructed in accordance with the principles of this invention can be utilized to captively retain various articles, the presently preferred embodiment described herein was designed for retaining marbles and accordingly the invention is best understood with reference to the use of marbles. Generally marbles are considered as children's toys and have been used in various types of marble games for many years. As is known, marbles are also played in tournaments and contests so that there is a substantial usage of marbles other than in children's games. People generally consider marbles as being carried in a player's pocket or a separate pouch having a top closable by a draw string. Such ways of carrying marbles, although simple, are not entirely satisfactory as it permits the surfaces of adjacent marbles to contact each other such that the marble surfaces may become pitted upon the marbles being forced into engagement with each other as occurs when a marble pouch is dropped. For the more serious marble player such surface pitting is objectionable in that pitting adversely affects the shooting and trajectory of the marble. In at least some marble games it is necessary throughout the game to pick up and remove certain marbles from the playing surface so that it is desirable that the marbles can be quickly and easily stored without interrupting the player's concentration on the game. In other instances it is necessary that a player provide additional marbles for the game and it is desirable that a number of marbles be readily available to a player throughout the game. Also it is desirable that a marble container be retained by a player in a manner so as not to interfere with the play of the game.

Accordingly, one object of this invention is to provide a new and novel elongated container for a plurality of articles which permits easy insertion and withdrawal of articles throughout a length of the container.

Another object of this invention is to provide a new and novel elongated container for a plurality of articles which may be comfortably worn by an individual.

A more specific object of this invention is to provide an elongated open-sided resiliently deformable container for captively receiving a plurality of articles throughout the length thereof.

Still another specific object of this invention is to provide an elongated marble container formed from corrugated and flexible plastic material having a generally C shape in cross section to permit marbles to be inserted throughout the length of the container.

These, other and more specific objects of this invention will become more apparent upon consideration of the following detailed description of a presently preferred embodiment thereof with relation to the drawings thereof in which.

Figure 1:
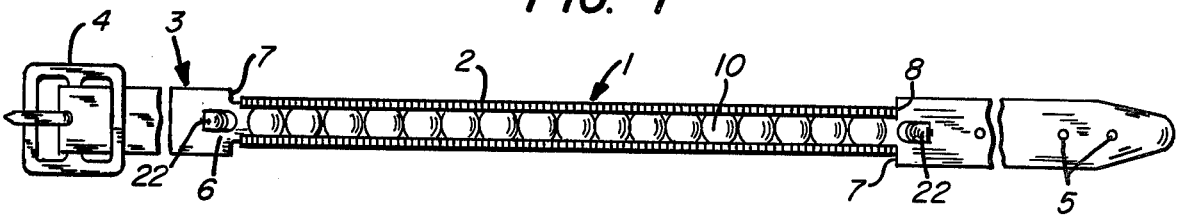
FIG. 1 is a side elevational view of a container constructed in accordance with the principles of this invention.

The marble belt or container 1 of this invention comprises an elongated housing or retainer 2 which is generally C-shaped in cross section and an elongated formed belt element 3 which extends throughout the housing 2 in engagement with the bight portion thereof and outwardly from each end of the housing 2. One end of element 3 is formed to retain in a well known manner a buckle 4. The other end of element 3 is provided with a series of longitudinally adjacent holes 5 for selectively receiving the tongue of the buckle 4 whereby the ends of element 3 function in the well known manner of a garment belt.

Housing 2 is formed of a suitable material having sufficient flexibility to permit the housing 2 to flex about the body of a wearer without increasing the lateral extent of the opening between the outwardly extending upper and lower portions 18 of housing 2 so that articles, such as marbles 10, carried within the housing 2 will not fall outwardly of the housing 2 during use. Housing 2 can be formed from various plastic materials and have a variety of shapes in cross section to captively retain the marbles 10; however, housing 2 is preferably formed from a corrugated plastic material with parallel corrugations 16. Corrugations 16 facilitate transverse flexing of housing 2 without substantially affecting the extent of the opening between portions 18. Once the belt has been secured to a wearer in the normal manner about the waist or chest, the marbles 10 may easily be inserted between the portions 18 at any location along the housing 2. Portions 18 are spaced a smaller transverse distance than the diameter of an inserted marble 10 so that upon insertion the outer surface of an inserted marble 10 causes the portions 18 of housing 2 to separate from each other to permit the marble 10 to enter the interior of housing 2. During such insertion the corrugations 16 of the preferred structure facilitate the separation of portions 18 without adversely increasing the opening between the portions of portions 18 adjacent the portions 18 through which a marble 10 is being inserted. Once a marble 10 has been so inserted the previously deformed portion 18 of housing 2 resiles to its original form to captively retain the marble 10 within the housing 2. Accordingly, portions 18 are spaced from each other and the cross-section of housing 2 is of a size to permit a marble 10 to be easily inserted and thereafter captively retained within housing 2.

Figure 2:
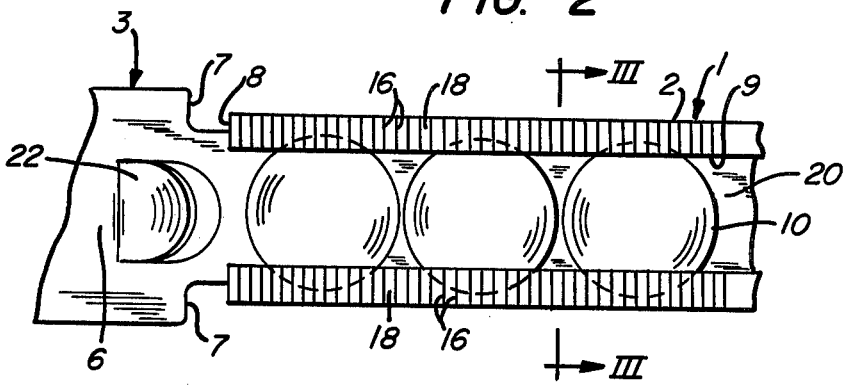
FIG. 2 is an enlarged view of the encircled portion of the container of FIG. 1.
Figure 3:
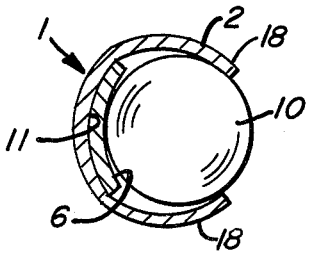
FIG. 3 is a cross-sectional view of the portion of the container shown in FIG. 2 taken along line III—III therof.

The portion 20 of belt element 3 in engagement with the bight portion 11 of housing 2 is of a smaller transverse width than the portions thereof outwardly adjacent the ends 8 of housing 2 to provide shoulders 7 engageable with the ends 8 and prevent the housing 2 from shifting longitudinally relative to the belt element 3. If desired, the portion 20 may be fixed to such bight portion in any suitable manner such as by being sealed (adhesive or heat seals) or mechanically connected. Portion 20 also forms a smooth raceway within housing 2 throughout the length thereof so that marbles 10 may easily be moved longitudinally throughout the housing 2. In use the most convenient manner of removing marbles 10 from the housing 2 is to slide and/or rotate the marbles 10 along such raceway to an open end of housing 2 to permit the marbles 10 to be removed one at a time and obtain the desired number of marbles 10. Preferably the portions of element 3 are provided with integral tongue portions or tabs 22 adjacent the ends 8 to engage the marbles 10. Such tabs 22 are readily deformable to permit their being easily depressed when desired. Accordingly, belt element 3 is preferably formed from a suitable flexible plastic material and such tabs 22 can readily be formed from such material by slitting the belt element 3. As shown, the right tab 22 (FIG. 2) is spaced outwardly of the end 8 of housing 2 to form a stop for engaging the outer surface of a marble 10 as it is being removed from housing 2 to reduce the tendency of a marble to fly outwardly of the housing 2. The left tab 22 (FIG. 1) is located within housing 2 to form a stop to retain the marbles 10 within housing 2 to prevent the marbles 10 from accidently falling out of the end of housing 2.

Although a housing 2 with an opening throughout its length is shown and described, such opening need only be of a length to permit the easy insertion of marbles 10 and to permit the marbles 10 to be readily moved longitudinally within the housing 2.

Although a preferred embodiment of this invention has been described in accordance with the Patent Statutes and some modifications thereto have been described, still other modifications may be made without departing from the scope of this invention by one skilled in the art and accordingly the invention is to be interpreted in accordance with the scope of the appended claims.

What is claimed is:

1. A container for a plurality of similar sized objects such as marbles which is adapted to be worn by an individual comprising, an elongated flexible belt member, cooperable means at the ends of said belt member to permit said belt member to be worn by an individual as an adjustable member, an elongated flexible housing encompassing an intermediate portion of said belt element, said housing having an elongated opening extending axially along at least the major extent of said housing, said intermediate portion being in engagement with an interior surface of said housing laterally opposite said opening, said housing being of substantially uniform cross section and of a form to captively retain a plurality of inserted objects of similar size in adjacent relationship, said housing consisting of laterally adjacent corrugations throughout at least said major extent, and said opening having a lateral extent to require deformation of said housing upon insertion of said objects therethrough.

2. A container as set forth in claim 1 in which said housing is a generally C-shaped member in cross section.

3. A container as set forth in claim 1 in which said opening extends axially the entire length of said housing.

4. A container as set forth in claim 1 in which said intermediate portion has a smooth surface facing said opening to permit inserted objects to be readily moved thereover.

5. A container as set forth in claim 4 in which said housing is a generally C-shaped member in cross section.

6. A container as set forth in claim 4 in which said belt member has integral tab means to limit movement of such objects along said belt member.

* * * * *